US008584380B2

(12) United States Patent
Auger et al.

(10) Patent No.: US 8,584,380 B2
(45) **Date of Patent: *Nov. 19, 2013**

(54) SELF-ADJUSTING STUDS

(75) Inventors: Perry W. Auger, Tigard, OR (US); Sergio Cavaliere, Venice (IT)

(73) Assignee: NIKE, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/613,372

(22) Filed: Sep. 13, 2012

(65) Prior Publication Data

US 2013/0008054 A1 Jan. 10, 2013

Related U.S. Application Data

(63) Continuation of application No. 12/711,107, filed on Feb. 23, 2010, now Pat. No. 8,322,051.

(51) Int. Cl.
*A43B 5/00* (2006.01)
*A43C 15/06* (2006.01)

(52) U.S. Cl.
USPC ..... 36/67 R; 36/61; 36/134

(58) Field of Classification Search
USPC ..... 36/67 R, 61, 134
See application file for complete search history.

(56) References Cited

U.S. PATENT DOCUMENTS

| | | | |
|---|---|---|---|
| 303,287 | A | 8/1884 | Nunn |
| 830,324 | A | 9/1906 | Hunt |
| 1,355,827 | A | 10/1920 | Finneran |
| 1,361,078 | A | 12/1920 | Lynn |
| 1,528,782 | A | 11/1924 | Perry |
| 1,736,576 | A | 11/1929 | Cable |
| 1,876,195 | A | 9/1932 | Youmans |
| 2,070,269 | A | 2/1937 | Goldenberg |
| 2,087,945 | A | 7/1937 | Butler |
| 2,095,095 | A | 10/1937 | Howard |
| 2,185,397 | A | 1/1940 | Birchfield |
| 2,222,650 | A | 11/1940 | Brady |
| 2,258,734 | A | 10/1941 | Brady |
| 3,043,026 | A | 7/1962 | Semon |

(Continued)

FOREIGN PATENT DOCUMENTS

| | | |
|---|---|---|
| CA | 2526727 | 5/2007 |
| CN | 101951799 A | 1/2011 |

(Continued)

OTHER PUBLICATIONS

Partial Search Report for PCT/US2009/058522 dated Mar. 4, 2010.

(Continued)

*Primary Examiner* — Marie Patterson
(74) *Attorney, Agent, or Firm* — Banner & Witcoff, Ltd.

(57) ABSTRACT

Articles of footwear may include self-adjusting studs that adjust to various types of conditions, environmental changes, and applied forces. The self-adjusting studs may have a first portion and a second portion of different levels of compressibilities and/or retractabilities that compress and extend based on the type of surface on which the wearer is walking or running This footwear with self-adjusting studs may easily transition between surfaces of varying hardness without causing damage to the surface, but also providing the wearer with the necessary amount of traction on each type of surface. Wearers will enjoy the benefit of being able to move on various surfaces without the need to change their footwear multiple times to accommodate the wearer's varying traction needs on different surfaces.

15 Claims, 3 Drawing Sheets

(56) References Cited

U.S. PATENT DOCUMENTS 3,063,171 A 11/1962 Hollander
3,352,034 A 11/1967 Braun
3,481,820 A 12/1969 Jonas
3,487,563 A 1/1970 Austin
3,619,916 A 11/1971 Neri
3,631,614 A 1/1972 Rice
3,775,874 A 12/1973 Bonneville
3,951,407 A 4/1976 Calacurcio
4,096,649 A 6/1978 Saurwein
4,146,979 A 4/1979 Fabbrie
D255,957 S 7/1980 Pasquier
4,271,608 A 6/1981 Tomuro
4,375,728 A 3/1983 Dassler
4,375,729 A 3/1983 Buchanen, III
4,466,205 A 8/1984 Corbari
4,546,559 A 10/1985 Dassler
4,562,651 A 1/1986 Frederick et al.
4,633,600 A 1/1987 Dassler et al.
4,674,200 A 6/1987 Sing
4,715,133 A 12/1987 Hartjes et al.
4,833,796 A 5/1989 Flemming
4,873,774 A 10/1989 Lafever
5,024,007 A 6/1991 DuFour
5,221,379 A 6/1993 Nicholas
5,289,647 A 3/1994 Mercer
5,299,369 A 4/1994 Goldman
5,339,544 A 8/1994 Caberlotto
5,351,422 A 10/1994 Fitzgerald
5,367,791 A 11/1994 Gross et al.
5,384,973 A 1/1995 Lyden
5,410,823 A 5/1995 Iyoob
5,513,451 A 5/1996 Kataoka et al.
5,524,364 A 6/1996 Cole et al.
5,526,589 A 6/1996 Jordan
5,634,283 A 6/1997 Kastner
5,678,328 A 10/1997 Schmidt et al.
5,761,832 A 6/1998 George
5,775,010 A 7/1998 Kaneko
5,786,057 A 7/1998 Lyden et al.
5,806,209 A 9/1998 Crowley et al.
5,815,951 A 10/1998 Jordan
5,843,268 A 12/1998 Lyden et al.
5,887,371 A 3/1999 Curley, Jr.
5,906,872 A 5/1999 Lyden et al.
5,915,820 A 6/1999 Kraeuter et al.
5,946,828 A 9/1999 Jordan et al.
5,956,871 A 9/1999 Korsen
D415,340 S 10/1999 McMullin
5,979,083 A 11/1999 Robinson et al.
5,983,529 A 11/1999 Serna
6,029,377 A 2/2000 Niikura et al.
6,058,627 A 5/2000 Violette et al.
6,079,127 A 6/2000 Nishimura et al.
6,112,433 A 9/2000 Greiner
6,119,373 A 9/2000 Gebhard et al.
6,125,556 A 10/2000 Peckler et al.
6,256,907 B1 7/2001 Jordan et al.
6,357,146 B1 3/2002 Wordsworth et al.
6,389,714 B1 5/2002 Mack
6,438,873 B1 8/2002 Gebhard et al.
6,477,791 B2 11/2002 Luthi et al.
6,481,122 B2 11/2002 Brahler
D468,517 S 1/2003 Recchi et al.
6,550,160 B2 4/2003 Miller, II
6,647,647 B2 11/2003 Auger et al.
6,658,766 B2 12/2003 Kraeuter et al.
6,675,505 B2 1/2004 Terashima
6,698,110 B1 3/2004 Robbins
6,739,075 B2 5/2004 Sizemore
D495,122 S 8/2004 McMullin
6,834,446 B2 12/2004 McMullin
6,857,205 B1 2/2005 Fusco et al.
6,904,707 B2 6/2005 McMullin
6,915,595 B2 7/2005 Kastner
6,915,596 B2 7/2005 Grove et al.
6,920,705 B2 7/2005 Lucas et al.
6,941,684 B2 9/2005 Auger et al.
6,948,264 B1 9/2005 Lyden
7,007,410 B2 3/2006 Auger et al.
7,124,519 B2 10/2006 Issler
7,143,530 B2 12/2006 Hudson et al.
7,194,826 B2 3/2007 Ungari
7,204,044 B2 4/2007 Hoffer et al.
7,207,125 B2 4/2007 Jeppesen
7,234,250 B2 6/2007 Fogarty et al.
7,243,445 B2 7/2007 Manz et al.
7,254,909 B2 8/2007 Ungari
7,269,916 B2 9/2007 Biancucci et al.
7,287,343 B2 10/2007 Healy
7,370,439 B1 5/2008 Myers
7,386,948 B2 6/2008 Sink
7,406,781 B2 8/2008 Scholz
7,409,783 B2 8/2008 Chang
7,430,819 B2 10/2008 Auger et al.
7,490,418 B2 2/2009 Obeydani
7,523,566 B2 4/2009 Young-Chul
7,559,160 B2 7/2009 Kelly
7,584,554 B2 9/2009 Fogarty et al.
7,650,707 B2 1/2010 Campbell et al.
7,654,013 B2 2/2010 Savoie et al.
7,654,014 B1 2/2010 Moore et al.
7,707,748 B2 5/2010 Campbell
7,784,196 B1 8/2010 Christensen et al.
7,818,897 B2 10/2010 Geer
D632,466 S 2/2011 Kasprzak
7,954,257 B2 6/2011 Banik
8,079,160 B2 12/2011 Baucom et al.
8,122,617 B1 2/2012 Dixon et al.
8,256,145 B2 9/2012 Baucom
8,322,051 B2 * 12/2012 Auger et al. ..... 36/67 R
8,356,428 B2 1/2013 Auger et al.
8,453,349 B2 6/2013 Auger et al.
2001/0005947 A1 7/2001 Sordi
2002/0017036 A1 2/2002 Berger et al.
2002/0062578 A1 5/2002 Lussier et al.
2002/0078603 A1 6/2002 Schmitt, Jr.
2002/0100190 A1 8/2002 Pellerin
2002/0178619 A1 12/2002 Schaudt et al.
2003/0033731 A1 2/2003 Sizemore
2003/0188458 A1 10/2003 Kelly
2004/0000075 A1 1/2004 Auger et al.
2004/0035024 A1 2/2004 Kao
2004/0187356 A1 9/2004 Patton
2004/0250451 A1 12/2004 McMullin
2005/0016029 A1 1/2005 Auger et al.
2005/0072026 A1 4/2005 Sink
2005/0108898 A1 5/2005 Jeppesen et al.
2005/0217149 A1 10/2005 Ho
2005/0257405 A1 11/2005 Kilgore
2005/0268490 A1 12/2005 Foxen
2006/0016101 A1 1/2006 Ungari
2006/0021254 A1 2/2006 Jones
2006/0021255 A1 2/2006 Auger et al.
2006/0130372 A1 6/2006 Auger et al.
2006/0242863 A1 11/2006 Patmore
2007/0199211 A1 8/2007 Campbell
2007/0199213 A1 8/2007 Campbell et al.
2007/0261271 A1 11/2007 Krouse
2008/0066348 A1 3/2008 O'Brien et al.
2008/0072457 A1 3/2008 Shakoor et al.
2008/0196276 A1 8/2008 McMullin
2008/0216352 A1 9/2008 Baucom et al.
2009/0056169 A1 3/2009 Robinson, Jr. et al.
2009/0056172 A1 3/2009 Cho
2009/0100716 A1 4/2009 Gerber
2009/0100718 A1 4/2009 Gerber
2009/0126230 A1 5/2009 McDonald et al.
2009/0223088 A1 9/2009 Krikorian et al.
2009/0241370 A1 10/2009 Kimura
2009/0249648 A1 10/2009 Brown et al.
2009/0249652 A1 10/2009 Gunthel et al.
2009/0307933 A1 12/2009 Leach
2009/0313856 A1 12/2009 Arizumi
2010/0005684 A1 1/2010 Nishiwaki et al.

(56) References Cited

U.S. PATENT DOCUMENTS

| | | | |
|---|---|---|---|
| 2010/0050475 | A1 | 3/2010 | Benz et al. |
| 2010/0077635 | A1 | 4/2010 | Baucom et al. |
| 2010/0083539 | A1 | 4/2010 | Norton |
| 2010/0083541 | A1 | 4/2010 | Baucom et al. |
| 2010/0212190 | A1 | 8/2010 | Schmid |
| 2010/0251578 | A1 | 10/2010 | Auger et al. |
| 2010/0313447 | A1 | 12/2010 | Becker et al. |
| 2011/0047830 | A1 | 3/2011 | Francello et al. |
| 2011/0078922 | A1 | 4/2011 | Cavaliere et al. |
| 2011/0078927 | A1 | 4/2011 | Baker |
| 2011/0126426 | A1 | 6/2011 | Amark |
| 2011/0146110 | A1 | 6/2011 | Geer |
| 2011/0167676 | A1 | 7/2011 | Benz et al. |
| 2011/0192056 | A1 | 8/2011 | Geser et al. |
| 2011/0197475 | A1 | 8/2011 | Weidl et al. |
| 2011/0197478 | A1 | 8/2011 | Baker |
| 2011/0203136 | A1 | 8/2011 | Auger |

FOREIGN PATENT DOCUMENTS

| | | |
|---|---|---|
| DE | 930798 | 7/1955 |
| DE | 1809860 | 4/1960 |
| DE | 2927635 | 1/1981 |
| DE | 3046811 | 7/1982 |
| DE | 3245182 | 5/1983 |
| DE | 3600525 | 10/1987 |
| DE | 3703932 | 8/1988 |
| DE | 3644812 | 9/1988 |
| DE | 102008033241 | 11/2009 |
| EP | 0223700 | 5/1987 |
| EP | 340053 | 11/1989 |
| EP | 0723745 | 7/1996 |
| EP | 890321 | 1/1999 |
| EP | 965281 | 12/1999 |
| EP | 1025771 | 8/2000 |
| EP | 1106093 | 6/2001 |
| EP | 1234516 | 8/2002 |
| EP | 1369049 | 12/2003 |
| EP | 1714571 | 10/2006 |
| EP | 1839511 | 10/2007 |
| EP | 2014186 | 1/2009 |
| EP | 2057913 | 5/2009 |
| EP | 2286684 | 2/2011 |
| EP | 2305056 | 4/2011 |
| EP | 2319342 | 5/2011 |
| EP | 2499928 | 9/2012 |
| FR | 1554061 | 1/1969 |
| FR | 2567004 | 1/1986 |
| FR | 2608387 | 6/1988 |
| FR | 2775875 | 9/1999 |
| FR | 2818876 | 7/2002 |
| GB | 1329314 | 9/1973 |
| GB | 2020161 | 11/1979 |
| GB | 2256784 | 12/1992 |
| GB | 2340378 | 2/2000 |
| GB | 2377616 | 1/2003 |
| JP | 8214910 | 8/1996 |
| JP | 10000105 | 6/1998 |
| JP | 11276204 | 10/1999 |
| JP | 2000236906 | 9/2000 |
| JP | 2002142802 | 5/2002 |
| JP | 2003284605 | 10/2003 |
| JP | 2004024811 | 1/2004 |
| JP | 2006198101 | 8/2006 |
| JP | 2008212532 | 9/2008 |
| TW | 540323 U | 7/2003 |
| TW | M267886 U | 6/2005 |
| WO | 9807341 | 2/1998 |
| WO | 9820763 | 5/1998 |
| WO | 0053047 | 9/2000 |
| WO | 03071893 | 9/2003 |
| WO | 2006103619 | 10/2006 |
| WO | 2007138947 | 12/2007 |
| WO | 2008069751 | 6/2008 |
| WO | 2008128712 | 10/2008 |
| WO | 2009110822 | 9/2009 |
| WO | 2010036988 | 4/2010 |
| WO | 2010057207 | 5/2010 |
| WO | 2012150971 | 11/2012 |

OTHER PUBLICATIONS

International Search Report and Written Opinion of PCT/US2010/029640 dated May 17, 2010.

International Search Report and Written Opinion of PCT/US2009/058522 dated Feb. 17, 2010.

International Search Report and Written Opinion for PCT/US2010/050637 dated Jan. 14, 2011.

International Search Report and Written Opinion for PCT/US2011/022841 dated Apr. 15, 2011.

International Search Report and Written Opinion for PCT/US2011/022848 dated Jun. 20, 2011.

Aug. 12, 2010, Icebug web page (date based on information from Internet Archive).

Dec. 23, 2008, Icebug web page (date based on information from Internet Archive).

International Search Report and Written Opinion for PCT/US2011/045356 dated Dec. 16, 2011.

International Search Report and Written Opinion mailed Jun. 13, 2012 in International Application No. PCT/US2012/021663.

Office Action mailed Jun. 13, 2012 in U.S. Appl. No. 12/582,252.

International Preliminary Report on Patentability (including Written Opinion of the ISA mailed May 3, 2012 in International Application No. PCT/US2010/053340.

Wiki(Boot)Leaks: adiZero II & adipure11Pro-More Info!, dated Jun. 22, 2011, accessed Aug. 25, 2011. http://www.soccerreviews.com.

Invitation to Pay Additional Fees mailed May 4, 2011 in International Application No. PCT/US2010/053340.

International Search Report and Written Opinion mailed Aug. 12, 2011 in International Application No. PCT/US2010/053340.

Pending U.S. Appl. No. 13/561,608, filed Jul. 30, 2012.

Pending U.S. Appl. No. 13/561,557, filed Jul. 30, 2012.

Pending U.S. Appl. No. 13/705,600, filed Dec. 5, 2012.

Pending U.S. Appl. No. 13/705,622, filed Dec. 5, 2012.

International Search Report and Written Opinion mailed Mar. 8, 2013 in International Application No. PCT/ US2012/052965.

International Search Report and Written Opinion mailed Mar. 8, 2013 in International Application No. PCT/US2012/052968.

International Search Report and Written Opinion mailed Mar. 8, 2013 in International Application No. PCT/US2012/052970.

Invitation to Pay Additional Fees and, Where Applicable, Protest Fee mailed Jan. 7, 2013 in International Application No. PCT/US2012/052968.

Invitation to Pay Additional Fees and, Where Applicable, Protest Fee mailed Jan. 8, 2013 in International Application No. PCT/US2012/052970.

Invitation to Pay Additional Fees and, Where Applicable, Protest Fee mailed Jan. 7, 2013 in International Application No. PCT/US2012/052965.

International Search Report and Written Opinion mailed Jan. 22, 2013 in International Application No. PCT/US2012/052972.

Invitation to Pay Additional Fees and, Where Applicable, Protest Fee mailed Feb. 8, 2013 in International Application No. PCT/US2012/052963.

First Office Action in CN200980137560.9 dated Feb. 8, 2013.

* cited by examiner

SELF-ADJUSTING STUDS

CROSS-REFERENCE TO RELATED APPLICATION

This application is a continuation of and claims priority to U.S. patent application Ser. No. 12/711,107, titled "Self-Adjusting Studs" and filed Feb. 23, 2010, now U.S. Pat. No. 8,322,051. application Ser No. 12/711,107, in its entirety, is incorporated by reference herein.

FIELD OF THE INVENTION

Aspects of the invention relate generally to traction elements for articles of manufacture and articles of wear. In some more specific examples, aspects of the invention relate to self-adjusting traction elements for articles of footwear.

BACKGROUND

Many articles of wear benefit from traction elements. Such articles of wear come into contact with a surface or another item and benefit from the increased friction and stability provided by traction elements. Traction elements typically form a portion of the ground-contact surface of the article of wear. Many traction elements form protrusions that extend away from the surface of the article of wear toward the ground or other surface that contacts the article of wear. Some traction elements are shaped or configured to pierce the ground or surface when the article of wear comes into contact with the ground or surface. Other traction elements are shaped or have characteristics that engage with the ground in a way that increases the friction between the article of wear and the surface that it contacts. Such traction elements increase lateral stability between the traction element and the ground or surface and reduce the risk that the article of wear will slide or slip when it contacts the ground or surface.

Many people wear footwear, apparel, and athletic and protective gear and expect these articles of wear to provide traction and stability during use. For example, articles of footwear may include traction elements that are attached to a sole structure that forms the ground-contact surface of the article of footwear. The traction elements provide gripping characteristics that help create supportive and secure contact between the wearer's foot and the ground. These traction elements typically increase the surface area of the ground-contact surface of the footwear and often form protrusions that are usually shaped or configured to pierce the ground and/or create friction between the ground-contact surface of the footwear and the ground or surface that it contacts.

These traction elements usually are solid protrusions that are static with respect to the article of footwear. This means that the traction elements and the footwear move as a single unit, i.e., the traction elements remain stationary with respect to the footwear. The traction elements progress through the bending and flexing motions of the step or run cycle in the same way as the rest of the sole structure of the footwear. This configuration limits traction capabilities because it cannot adapt to the various forces being applied to the article of wear or the changing environments in which the article of footwear is being used.

Athletes engaged in certain sports such as soccer, baseball, and football often utilize footwear having traction elements. These athletes perform various movements that have sudden starts, stops, twisting, and turning. Additionally, most athletes wish to wear their articles of footwear in various environments with surfaces having different conditions and characteristics. On many occasions, the static traction elements are unable to provide adequate support and traction that the athlete needs to perform the various movements. The static traction elements simply cannot adapt to the changing movements of these athletes or the various environments in which the athletes wear the articles of footwear. Rather, the static traction elements provide the same type and amount of traction during all movements and in all environments, regardless of the type of movement being performed by the athlete or the characteristics of the environment in which the articles of footwear are being worn.

Additionally, various surfaces on which the athlete wishes to wear their articles of footwear have many different characteristics including different hardnesses and contours. For example, an athlete may utilize studded footwear on a playing field made of grass or a synthetic material similar in nature to grass. Many of these playing fields are outdoors and the conditions of the fields are subject to weather conditions, varying degrees of maintenance performed on the surfaces, regional (geographical) surface differences, and the like. For example, athletes that usually practice on a grass field that is rather soft may find that their cleated footwear functions differently on a grass field that is hard, such as when the athlete plays a game at another location or the weather causes the field conditions to harden the surface. By wearing the same cleats on all surfaces, wearers are at greater risk of falling, sliding, and/or otherwise injuring themselves, at least under such circumstances in which the static traction elements provided on the article of footwear are not well-designed for use under the field conditions. The alternative is to purchase several different pairs of cleated footwear with varying types of traction to accommodate several different surfaces. However, this method is expensive and inconvenient.

Therefore, while some traction elements are currently available, there is room for improvement in this art. For example, articles of wear having traction elements that may be self-adjusting to provide a user with traction that automatically adjusts based on the type of surface with which the article of wear is in contact and the types of forces applied to the traction elements would be a desirable advancement in the art.

SUMMARY

The following presents a general summary of aspects of the invention in order to provide a basic understanding of at least some of its aspects. This summary is not an extensive overview of the invention. It is not intended to identify key or critical elements of the invention and/or to delineate the scope of the invention. The following summary merely presents some concepts of the invention in a general form as a prelude to the more detailed description provided below.

Aspects of this invention relate to self-adjusting traction elements for articles of wear, such as footwear. In an example footwear embodiment, the article of footwear may incorporate a sole structure having one or more self-adjusting traction elements or "self-adjusting studs."

In an example, a self-adjusting stud may comprise a first portion having a first retractability and a second portion having a second retractability that is less than the first retractability. The second portion may surround the first portion. The first portion and the second portion may be substantially unretracted when the self-adjusting stud comes into contact with a surface of a first hardness and the first portion is refracted and the second portion is substantially unretracted when the self-adjusting stud comes into contact with a surface of a second hardness, and wherein the first hardness is less than the second hardness.

In yet another example, a self-adjusting stud may comprise an impact-attenuating assembly, a plunger, and a tip. The impact-attenuating assembly may have a first surface, a second surface, and a hole therethrough. The plunger may be positioned adjacent to the first surface of the impact-attenuating assembly and further positioned to activate the impact-attenuating assembly when a force is applied to the plunger. At least a portion of the plunger extends through the hole of the impact-attenuating assembly. The tip may be positioned adjacent the second surface of the impact-attenuating assembly. The tip may engage with the portion of the plunger that extends through the hole of the impact-attenuating assembly. The tip and the plunger may be positioned on opposite sides of the impact-attenuating assembly. The tip may be in a refracted position when the impact-attenuating assembly is in a first, unactivated state and the tip may be in an extended position when the impact-attenuating assembly is in a second, activated state.

In yet another example, a sole structure may comprise a sole base member and at least one self-adjusting stud attached thereto. The self-adjusting stud may be any of the example embodiments described above. In some examples, the sole structure includes more than one self-adjusting stud, either of the same embodiment or of different embodiments of the self-adjusting stud.

BRIEF DESCRIPTION OF THE DRAWINGS

A more complete understanding of the present invention and certain advantages thereof may be acquired by referring to the following description along with the accompanying drawings, in which like reference numbers indicate like features, and wherein.

Figure 1:
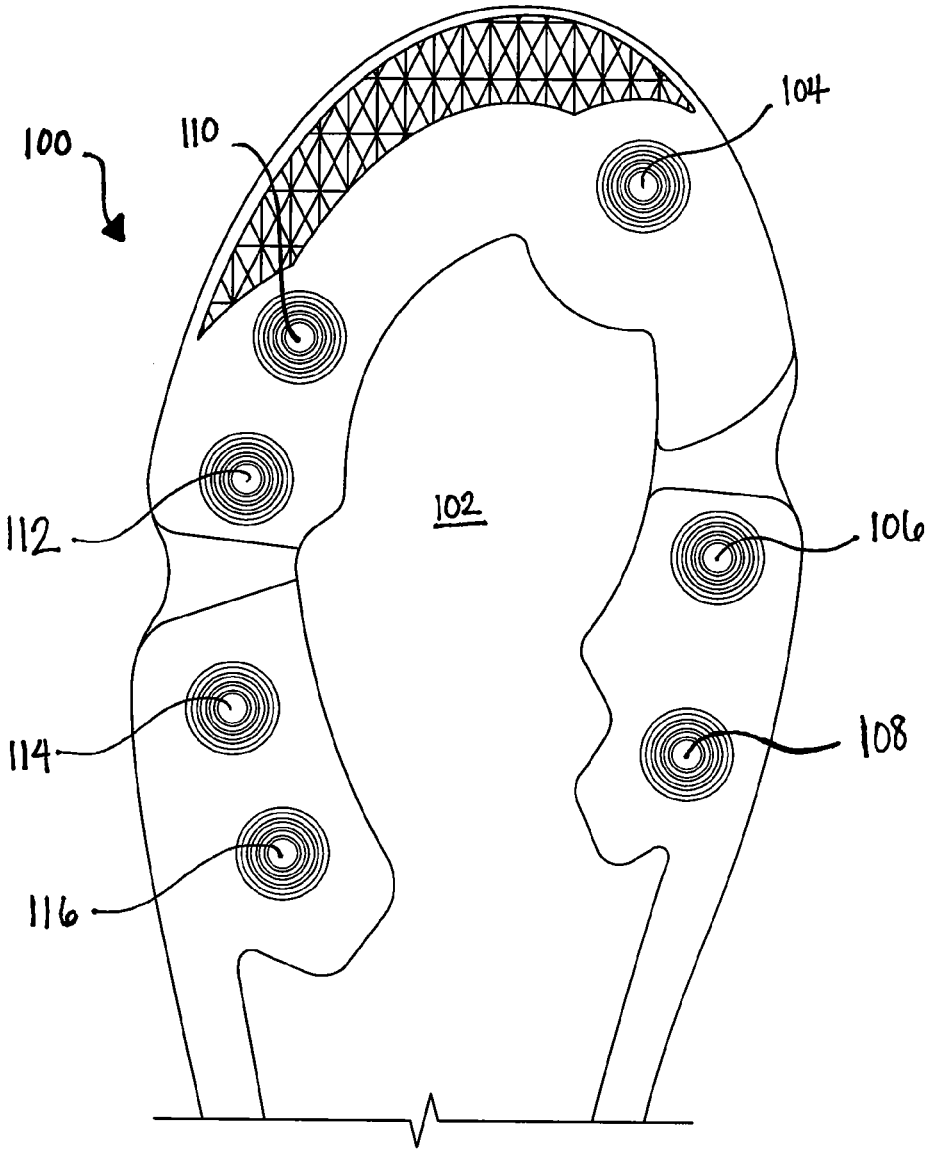
FIG. 1 illustrates a bottom plan view of a portion of a sole structure of an article of footwear having a plurality of self-adjusting studs, according to an aspect of the invention.

The reader is advised that the attached drawings are not necessarily drawn to scale.

DETAILED DESCRIPTION

In the following description of various example embodiments of the invention, reference is made to the accompanying drawings, which form a part hereof, and in which are shown by way of illustration various example devices, systems, and environments in which aspects of the invention may be practiced. It is to be understood that other specific arrangements of parts, example devices, systems, and environments may be utilized and structural and functional modifications may be made without departing from the scope of the present invention.

The articles of footwear disclosed herein include one or more self-adjusting studs that change their traction characteristics based on the type of surface with which the self-adjusting stud contacts, and/or the type of force that is applied to the self-adjusting stud thereby providing greater overall versatility and stability of the studded footwear and decreasing the chances that the wearers will get injured by unexpected or unfamiliar field conditions.

A. Definitions Section

To assist and clarify the subsequent description of various embodiments, various terms are defined herein. Unless otherwise indicated, the following definitions apply throughout this specification (including the claims).

The term "compressibility," as used herein, means the ability of the first portion and/or the second portion to condense, become more compact, or otherwise become reduced in size. The term "compressibility," as used herein, is used to describe the ability of a portion of a self-adjusting stud to become reduced in size in any way (height, width, thickness, volume, or any other reduction in size). A particular portion of the self-adjusting stud may be described as having a particular level of "compressibility," which means that it has been constructed with an ability to compress with respect to another portion of the self-adjusting stud.

For example, a first portion and a second portion of a self-adjusting stud may be assigned different "compressibilities" as they relate to each other. The first portion may compress more or less (depending on the embodiment) than the second portion with respect to a surface having a defined hardness (such as a hard surface like a gymnasium, artificial turf, or a frozen or near-frozen playing field). Atomically speaking, any force applied to a solid object will "compress" the atoms in the object to some degree (even objects made of the hardest materials available). However, the term "compressibility," as used herein, is meant to refer to a measurable difference in the amount of compression that occurs in a particular portion of the self-adjusting stud.

The terms "substantially uncompressed" and "compressed," as used herein, are meant to describe levels of compression of various portions of the self-adjusting studs. As discussed above, atomically speaking, any force applied to an object made of even the hardest of materials will "compress" the object to some degree. The term "substantially uncompressed," is intended to include those levels of compression in which none or only a very small amount of compression occurs (e.g., when the atoms move only slightly closer together). For example, a hard metal, such as titanium, may be used to form a portion of the self-adjusting stud. This titanium metal portion would typically be able to withstand most forces in a "substantially uncompressed" form because it does not substantially compress or become reduced in size when such forces are applied to it.

Use of the term "substantially uncompressed" is meant to include the levels of compressibility in which mere atoms move, but no noticeable change in traction capabilities occurs, such as in the titanium example previously described. The term "compressed," as used herein, is used to describe a noticeable or detectable difference in the volume or size of any portion of the self-adjusting stud from the perspective of an athlete or user or a size or volume difference that is measurable by generally available measurement tools, such as a ruler or detectable by the human eye. The difference will often, although not always, result in a size or volume change such that the traction characteristics of the self-adjusting stud will exhibit a noticeable change from the perspective of the athlete/wearer. In some example structures, the self-adjusting stud may compress up to 5-15% of its uncompressed size/shape. For example, if the compression occurs in the vertical direction, the height of the self-adjusting stud may be 5% less when it is compressed than when it is substantially uncompressed.

The term "retractability," as used herein, means the ability of any portion of the self-adjusting stud to retract or otherwise make its size smaller. In some situations, the term "retractability" may mean that a portion is pulled back into another portion of the self-adjusting stud. For example, a first portion of the self-adjusting stud may retract or pull back into the interior space of a second portion of the self-adjusting stud in a reverse cascading fashion.

The term "hardness," as used herein is used to describe the type of surface that comes into contact with the self-adjusting stud. For example, a soft surface would have a lower hardness level than a hard surface. The soft surface may include a grass playing field or a field with flexible ground. The hard surface may include an artificial playing field or a playing field with firm ground. As described in greater detail below, the self-adjusting studs may be activated (compressed/retracted) on either hard or soft surfaces, depending on the embodiment.

B. General Description of Articles of Footwear with Self-Adjusting Studs

The following description and accompanying figures disclose various articles of footwear that have self-adjusting studs. The self-adjusting studs may be incorporated into any article of manufacture or article of wear that would benefit from self-adjusting studs, such as, but not limited to, footwear, sporting equipment, protective gear, mats, and the like.

Sole structures of articles of footwear may have self-adjusting studs. The self-adjusting studs may be discrete elements from the sole structure or may be integrally formed with or incorporated into the sole structure. In some examples, the self-adjusting studs may be detachable (and/or replaceable) from the sole structure altogether. In other examples, the self-adjusting studs may be permanently attached to the sole structure and may be either a separate construction or may be formed from the same piece of material as the sole structure.

The sole structures may be incorporated into any type of article of footwear. In more specific examples, the sole structures are incorporated into athletic footwear for sports including, but not limited to soccer, football, baseball, track, golf, mountain climbing, hiking, and any other sport or activity in which an athlete would benefit from a sole structure having self-adjusting studs.

Generally, articles of footwear comprise an upper attached to a sole structure. The sole structure extends along the length of the article of footwear and may comprise an outsole that forms the ground contacting surface of the article of footwear. Traction elements may be attached to and form portions of the sole structure and/or ground contacting surface (e.g., the outsole). In some examples, the sole structure includes a sole base member and one or more self-adjusting studs.

Articles of footwear may generally be divided into three regions for explanatory purposes. The demarcation of each region is not intended to define a precise divide between the various regions of the footwear. The regions of the footwear may be a forefoot region, a midfoot region, and a heel region. The forefoot region generally relates to the portion of the foot of a wearer comprising the metatarsophalangeal joints and the phalanges. The midfoot region generally relates to the portion of the foot of a wearer comprising the metatarsals and the "arch" of the foot. The heel region generally relates to the portion of the wearer's foot comprising the heel or calcaneus bone.

One or more self-adjusting studs may be positioned in any region or a combination of regions of the sole structure of the article of footwear. For example, one or more self-adjusting studs may be positioned in the forefoot region of the article of footwear. Further, self-adjusting studs may be positioned on any side of the article of footwear including the medial side and the lateral side. In more specific examples, a self-adjusting stud may be positioned along the medial or lateral edge of the sole structure of the footwear. The self-adjusting studs also may be placed in the heel region of the article of footwear. The self-adjusting studs may be strategically positioned to provide additional traction when the wearers most need it, i.e., during specific targeted activities and/or when a particular kind of force is applied to the sole structure by the ground and/or the wearer's foot. The self-adjusting studs may be positioned in any suitable configuration on the sole structure and in any region of the sole structure.

Athletes may greatly benefit from the additional traction capabilities of the self-adjusting studs in their footwear during certain movements. Athletes participating in athletic activities, for example, may need to perform sudden or abrupt starting, stopping, turning, and/or twisting motions. Athletes also make quick changes in direction of their movement. Additionally, athletes may wish to compete on various surfaces (e.g., varying field conditions or terrains). Athletes may benefit from self-adjusting studs during these movements and in these different environments of use.

Generally, traction elements (and specifically self-adjusting studs) cause friction between the sole structure and the ground or surface that they contact to provide support and stability to the users of the articles of footwear during various movements. Traction elements increase the surface area of the sole structure and are often shaped and/or configured to pierce the ground when contact with the ground occurs. Such contact decreases lateral and rearward slip and slide of the footwear with the ground and increases stability for the wearer. Self-adjusting studs can provide fraction that is tailored to specific movements and that can change its characteristics based on the type of terrain or surface with which the sole structure comes into contact and based on the type(s) of forces being applied to the sole structure.

The self-adjusting studs may be any suitable shape and size. The surfaces of the self-adjusting studs may be smooth or textured and curved or relatively flat. The self-adjusting studs may have a smooth surface or may have edges or "sides," such as a polygon. The self-adjusting studs may be conical, rectangular, pyramid-shaped, polygonal, or other suitable shapes. In one example, an article of footwear may have a plurality of self-adjusting studs that are all uniform in shape. In another example, the plurality of self-adjusting studs on a single article of footwear may have various shapes. The self-adjusting studs may be any size. In the example configuration where a plurality of self-adjusting studs are attached to the sole structure, each of the self-adjusting studs may be the same size and/or shape or they may be of varying sizes and/or shapes. The ground-contact surface of the self-adjusting studs may be a point, a flat surface, or any other suitable configuration.

The sole structure may contain one or more self-adjusting studs. In some examples, the sole structure has a single self-adjusting stud. In another example, the sole structure has a plurality of self-adjusting studs. The self-adjusting stud(s) may be positioned within the forefoot region of the sole structure or any other region of the sole structure. For example, the sole structure may include a plurality of self-adjusting studs. A first portion of the plurality of self-adjusting studs may be positioned along the medial edge of the forefoot region of the sole structure and a second portion of the plurality of self-adjusting studs may be positioned along the lateral edge of the forefoot region of the sole structure. In essence, the plurality of studs may be positioned to frame the forefoot region along the border of the sole structure. This positioning helps to provide additional traction for the wearers during side-lateral movements.

In another example, the self-adjusting studs may be positioned in the heel region of the sole structure of the studded footwear. In even other examples, self-adjusting studs may be positioned in both the forefoot region and the heel region. By varying the configuration of the self-adjusting studs, the type of traction capabilities of the footwear can be varied and/or even customized to provide additional fraction to the wearer when the wearer performs a particular movement or engages in activities on surfaces having various characteristics.

Articles of footwear may include various types of self-adjusting studs. Some self-adjusting studs may be activated when the surface conditions change (i.e., such as the hardness and contour). For example, the self-adjusting studs may be activated when the surface conditions change from a relatively hard to a relatively soft condition. The self-adjusting studs may be activated by any change in the condition(s) of the surface that the article of footwear contacts.

In an example, the self-adjusting stud comprises a first portion having a first retractability and a second portion having a second retractability that is less than the first retractability. The second portion surrounds the first portion. The first portion and the second portion are substantially unretracted when the self-adjusting stud comes into contact with a surface of a first hardness and the first portion is refracted and the second portion is unretracted when the self-adjusting stud comes into contact with a surface of a second hardness, wherein the first hardness is less than the second hardness.

The first portion may include any type of material(s), including, but not limited to thermoplastic polyurethane, thermosetting materials, metal, rubber, various plastics, etc. The metal may be an alloy of metals (e.g., steel, aluminum, titanium, alloys containing one or more of these metals, etc.). The first portion remains substantially unretracted when it contacts a surface with a first hardness (a relatively soft surface). The first portion retracts when it contacts the surface with a second hardness (a relatively hard surface). The first portion includes a material or a structure that retracts when it contacts hard surfaces. Such a configuration causes the first portion to be extended to provide additional traction in soft (i.e., flexible) ground.

The first portion may be any structure that is capable of retracting and extending. In an example configuration, the first portion may include an impact-attenuating assembly having a hole therethrough, a plunger positioned to activate the impact-attenuating assembly when a force is applied to the plunger, and a tip that engages with a portion of the plunger. At least a portion of the plunger extends through the hole of the impact-attenuating assembly. The tip engages with the portion of the plunger that extends through the impact-attenuating assembly. The tip is in a retracted position when the impact-attenuating assembly is in a first, unactivated state (no force is being applied to the plunger that is sufficient to activate the impact-attenuating assembly) and the tip is in the extended position when the impact-attenuating assembly is in a second, activated state.

The impact-attenuating assembly may include an impact-attenuating element and an impact-attenuating element housing. The impact-attenuating element cushions or otherwise absorbs (and redirects) a force applied to the self-adjusting stud. In some examples, the force is applied to the plunger. The impact-attenuating element may include a spring, such as a leaf spring. The impact-attenuating element may also help to bias the impact-attenuating assembly back to its first, unactivated state after the force has been removed from the self-adjusting stud. The impact-attenuating element may receive a force that is applied to the self-adjusting stud when the self-adjusting stud contacts a hard surface. This construction permits the first portion to be extended in soft ground, thereby providing additional traction in the soft ground. The impact-attenuating assembly biases the first portion to its retracted position until a force is applied that is great enough to activate the impact-attenuating element and extend the first portion (i.e., when the self-adjusting stud contacts ground of a sufficient softness). The impact-attenuating element may be shaped and sized to fit within a space defined by the interior of the impact-attenuating element housing.

The second portion of this embodiment of the self-adjusting stud surrounds the first portion. The second portion may include any suitable materials, such as hard TPU, thermosetting materials, metal, or other hard plastics. The second portion includes material(s) that have a hardness that can withstand a wide variety of usual forces (e.g., running, jumping, sharp turns, changes in direction, twisting, pivoting, the wearer's weight, etc.) without deforming.

The second portion is positioned proximate to and, in some examples, in contact with the first portion in a manner such that the first portion may retract and extend freely. In some example constructions, the first portion retracts and extends into an interior space within the second portion. As discussed above, some examples of the first portion include an impact-attenuating assembly, a plunger, and a tip combination that extend and retract. This combination may extend and retract at least partially within (and out of) the second portion of the self-adjusting stud. The second portion remains substantially unretracted at all times (static or stationary). When the first portion is retracted, its ground-contact surface may be flush with the height of the second portion in some examples. In other examples, the ground-contact surface of the first portion may be retracted within the second portion or it may extend slightly beyond the ground-contact surface of the second portion. In any configuration, the first portion, in its retracted position, reduces the overall height (size) of the self-adjusting stud. This construction permits the first portion to be retracted when the self-adjusting stud comes into contact with hard ground and to be extended when the self-adjusting stud comes into contact with soft ground. In the extended position (in soft ground), the first portion can provide additional fraction for the athlete/wearer.

In some example configurations, the first portion and the second portion are cylindrical in shape and may be tapered as they extend away from the surface of the sole structure. In such a configuration, the first portion may have a radius that is slightly smaller than the radius of the second portion such that the first portion may retract and extend within the second portion. The first portion and the second portion may have flat sides or any other shape.

These example configurations of the self-adjusting studs are useful when the self-adjusting stud contacts relatively soft ground (e.g., ground soft enough to prevent the first portion from refracting). These configurations of the self-adjusting stud will "activate" in soft ground when the first portion is extended, which is able to pierce the soft ground and provide additional traction to the athlete/wearer. The hard ground causes the first portion to retract within the second portion and expose less (or none) of the first portion beyond the height of the second portion.

In these example configurations, the first portion may extend any suitable amount. For example, the size of the retracted first portion may be at least 5% smaller than the size of the unretracted first portion. In another example, the size of the extended first portion may be at least 25% smaller than the size of the unretracted first portion or even at least 50% smaller.

Specific examples of the invention are described in more detail below. The reader should understand that these specific examples are set forth merely to illustrate examples of the invention, and they should not be construed as limiting the invention.

C. Specific Examples of Articles of Footwear with Self-Adjusting Studs

The various figures in this application illustrate examples of articles of footwear with self-adjusting studs according to this invention. When the same reference number appears in more than one drawing, that reference number is used consistently in this specification and the drawings to refer to the same or similar parts throughout.

FIGS. 1-3B illustrate specific examples of the self-adjusting studs. FIG. 1 illustrates a bottom plan view of a portion of a forefoot region of an article of footwear 100. The article of footwear 100 has an upper and a sole structure 102 attached to the upper (the upper is not shown in these figures). Seven self-adjusting studs 104, 106, 108, 110, 112, 114, and 116 are attached to this example sole structure 102. A first 104 of the self-adjusting studs is positioned on the sole structure 102 such that it is positioned approximately beneath the first phalange ("big toe") of the wearer's foot when the wearer's foot is inserted within the article of footwear 100. The second 106 and third 108 self-adjusting studs are positioned along the medial edge of the forefoot region (and possibly extending into the midfoot region) of the sole structure 102 such that they extend along a longitudinal length of the first and/or the second metatarsals.

The fourth 110, fifth 112, sixth 114, and seventh 116 self-adjusting studs are positioned along the lateral edge of the sole structure 102 illustrated in FIG. 1. The fourth 110 and fifth 112 self-adjusting studs are positioned within the forefoot region of the sole structure 102 so that they extend along a longitudinal length of the fifth and possibly a portion of the fourth metatarsal of the wearer's foot when the wearer's foot is inserted within the article of footwear 100. The sixth 114 and seventh 116 self-adjusting studs are positioned within the forefoot region and a portion of the midfoot region of the sole structure 102 along a longitudinal length of the fourth and/or fifth metatarsals and possibly a portion of the tarsals of the wearer's foot if the wearer's foot was inserted into the article of footwear 100.

The self-adjusting studs 104, 106, 108, 110, 112, 114, and 116 illustrated in FIG. 1 are all positioned generally within the forefoot region of the sole structure 102. However, in alternative examples, one or more self-adjusting studs may be positioned in any other region of the article of footwear 100, such as the heel region. In still other examples, self-adjusting studs need not be positioned in the forefoot region.

Figure 2:
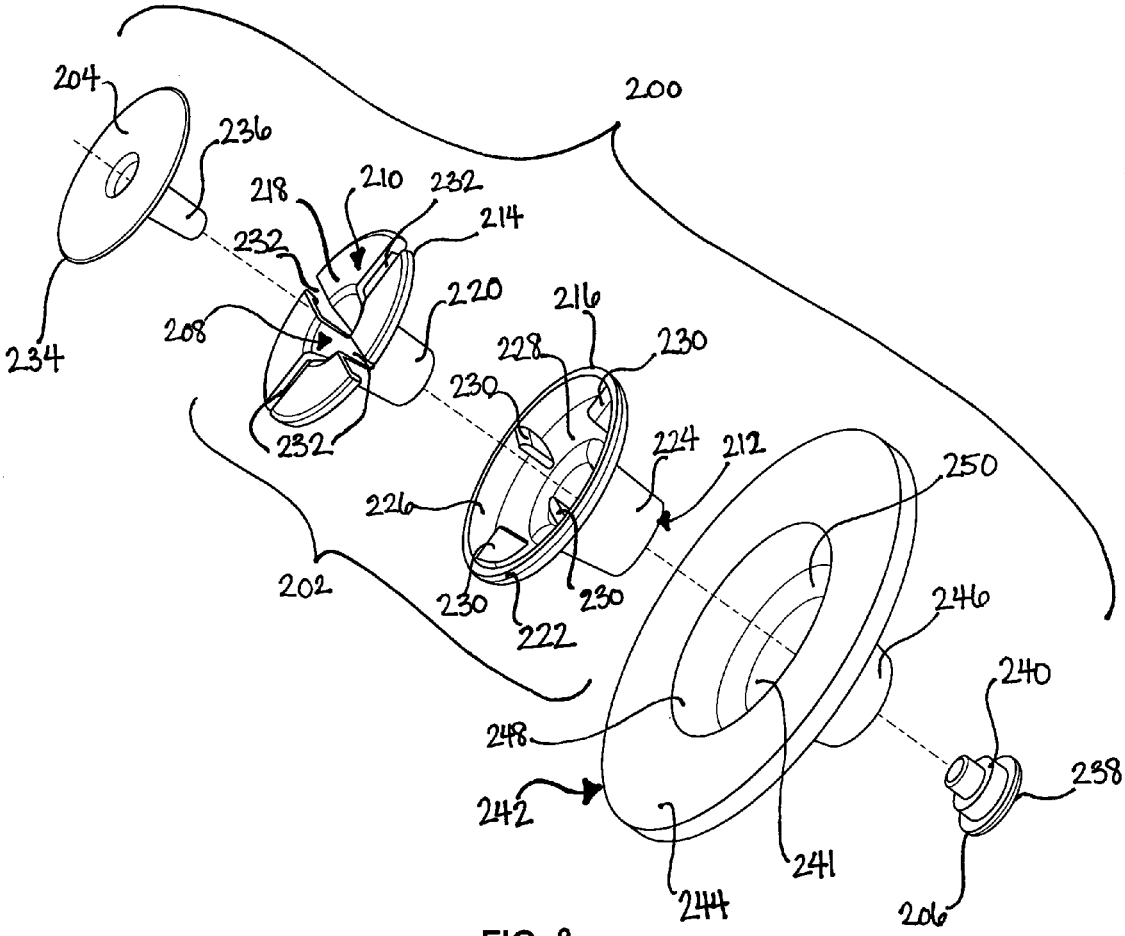
FIG. 2 illustrates an exploded view of the elements of the self-adjusting stud, according to aspects of the invention.

One example self-adjusting stud structure is illustrated in more detail in conjunction with FIG. 2. This self-adjusting stud 200 comprises an impact-attenuating assembly 202, a plunger 204, and a tip 206, which are illustrated in FIG. 2. The impact-attenuating assembly 202 defines a hole 208 extending through the impact-attenuating assembly 202 in approximately the center region of the impact-attenuating assembly 202. The impact-attenuating assembly 202 has a first surface 210 and a second surface 212 opposite the first surface 210. The plunger 204 is positioned adjacent to the first surface 210 of the impact-attenuating assembly 202. The plunger 204 is further positioned to activate the impact-attenuating assembly 202 when a force is applied to the plunger 204. At least a portion of the plunger 204 extends through the hole 208 of the impact-attenuating assembly 202. The tip 206 is positioned adjacent to the second surface 212 of the impact-attenuating assembly 202. The tip 206 engages with the portion of the plunger 204 that extends through the hole 208 of the impact-attenuating assembly 202. The tip 206 and the plunger 204 are positioned on opposite sides of the impact-attenuating assembly 202 and engage with one another through the hole 208 in the impact-attenuating assembly 202. The tip 206 is in a refracted position when the impact-attenuating assembly 202 is in a first, unactivated state and the tip 206 is in an extended position when the impact-attenuating assembly 202 is in a second, activated state.

At least a portion of the second surface 212 of the impact-attenuating assembly 202 and the tip 206 form a ground-contact surface for the self-adjusting stud. The impact-attenuating assembly 202 includes an impact-attenuating element 214 and an impact-attenuating element housing 216. The impact-attenuating element 214 is shaped to fit within the impact-attenuating element housing 216. The impact-attenuating element 214 has a first portion 218 and a second portion 220. The first portion 218 includes a leaf spring in this example. The first portion 218 of the impact-attenuating element 214 has a larger radius than the radius of the second portion 220. The second portion 220 of the impact-attenuating element 214 is generally tube-shaped and has a larger height/length than the first portion 218. The impact-attenuating element housing 216 also includes a first portion 222 and a second portion 224. The first portion 222 of the impact-attenuating element housing 216 defines an interior space 226 and a shoulder 228. When the impact-attenuating element 214 is positioned within the impact-attenuating element housing 216, the first portion 218 of the impact-attenuating element 214 is positioned within the interior space 226 of first portion 222 of the impact-attenuating housing 216 such that it is positioned proximate to (and in this example in physical contact with) the shoulder 228 of the impact-attenuating element housing 216.

The second portion 224 of the impact-attenuating element housing 216 is generally tube-shaped and is slightly larger than the second portion 220 of the impact-attenuating element 214. When the impact-attenuating element 214 is positioned within the impact-attenuating element housing 216, the second portion 220 of the impact-attenuating element 214 is fitted (or positioned to fit within) the second portion 224 of the impact-attenuating element housing 216. In alternative embodiments, the first portion 218 of the impact-attenuating element 214 may include any suitable type of impact-attenuating elements (e.g., compressible foam, any type of suitable spring, etc.).

In some example constructions, the impact-attenuating assembly 202 further includes a retaining mechanism that includes four slits 232, spaced evenly apart, within the first portion 218 of the impact-attenuating element 214 and four corresponding tabs 230, spaced evenly apart in a corresponding spacing to the slits 232, in the interior space 226 of the first portion 222 of the impact-attenuating element housing 216. When the impact-attenuating element 214 is positioned within the impact-attenuating element housing 216, the tabs 230 fit within the slits 232. When the tabs 230 are fitted within the slits 232, the impact-attenuating element 214 is substantially prevented from rotating with respect to the impact-attenuating element housing 216. The retaining mechanism also retains the impact-attenuating element 214 in a position that is adjacent to the impact-attenuating element housing 216. The retaining mechanism may include any number of tabs and corresponding slits. The tabs and slits may be spaced apart in any suitable manner.

The first portion 218 of the impact-attenuating element 214 includes a leaf spring 233, as described above. The leaf spring 233 is positioned proximate to (and in this example rests upon and is in physical contact with) the shoulder 228 of the first portion 222 of the impact-attenuating element housing 216 when the impact-attenuating element 214 is positioned within the impact-attenuating element housing 216. The plunger 204 has a first portion 234 and a second portion 236. The first portion 234 of the plunger 204 is generally flat and is the portion of the self-adjusting stud that receives a force and activates the impact-attenuating element 214. The second portion 236 of the plunger 204 extends down into the hole 208 of the impact-attenuating assembly 208. The first portion 234 of the plunger 204 causes the leaf spring 233 in the first portion 218 of the impact-attenuating element 214 to flex against the shoulder 228 of the first portion 222 of the impact-attenuating element housing 216. This action causes the second portion 224 of the impact-attenuating housing 216 to extend downward (in a direction away from the sole structure and toward the ground). The action of the plunger 204 causes the tip 206 to extend from a retracted position to an extended position. When the force has caused the leaf spring 233 to flex, the impact-attenuating element 214 is considered to be in its "second, activated state." When the leaf spring 233 is in its natural, unflexed state (no force is being applied), the impact-attenuating element 214 is considered to be in its "first, unactivated state."

Figure 3A:
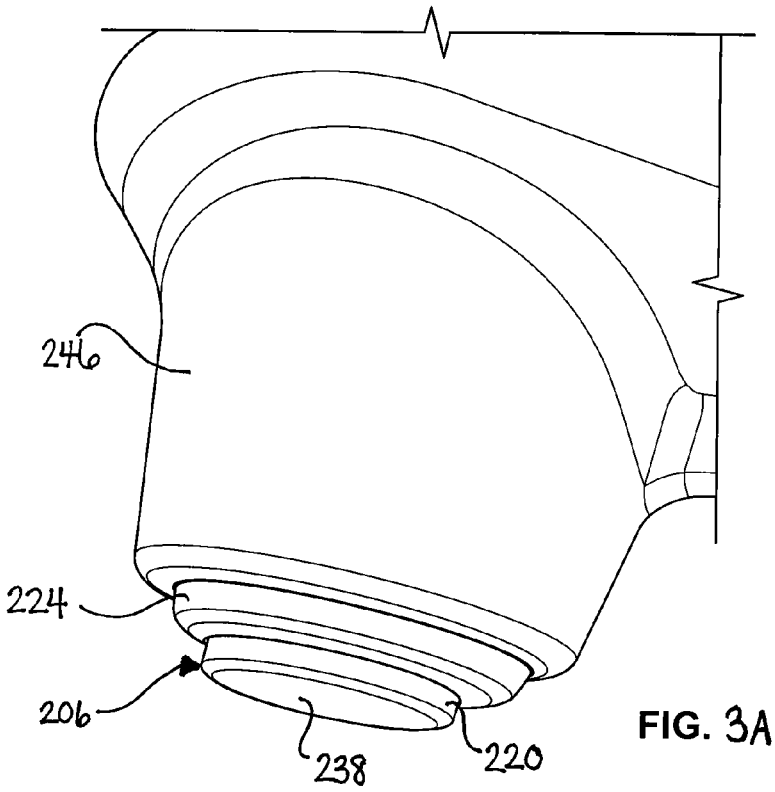
FIGS. 3A and 3B illustrate side perspective views of the self-adjusting studs in a retracted position and an extended position, respectively, according to aspects of the invention.
Figure 3B:
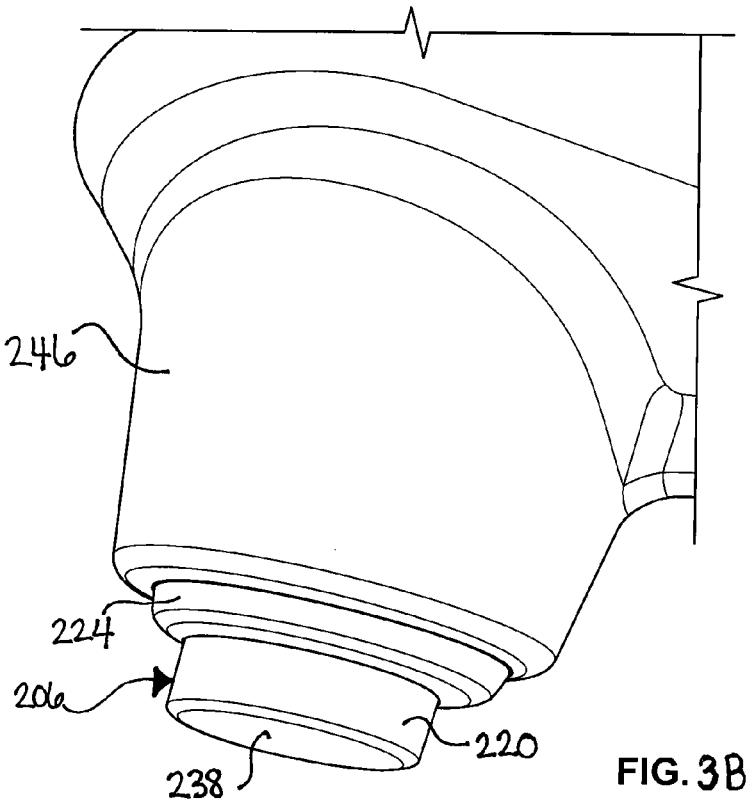

The tip 206 has a first portion 238 and a second portion 240. The first portion 238 of the tip 206 forms the ground-contact surface and the second portion 240 of the tip 206 engages with the second portion 236 of the plunger 204 within the hole 208 of the impact-attenuating assembly 202. The tip 206 extends along with the impact-attenuating assembly 202. FIG. 3A illustrates the tip 206 in its retracted position. FIG. 3B illustrates the tip 206 in its extended position. The tip 206 in its extended position provides the self-adjusting stud with additional fraction capabilities. When the tip 206 extends from its retracted position to its extended position, it appears to "cascade" out from the impact-attenuating assembly 202 and/or an annular stud base 242 (described in greater detail below). This construction will "activate" the additional traction capabilities of the self-adjusting stud (the tip 206 is caused to be extended) when the stud comes into contact with soft ground. The situation occurs when the force (e.g., such as from a wearer's foot) is applied to the plunger 204. When the ground is sufficiently hard, the force (e.g., such as the one applied by the wearer's foot) applied to the plunger 204 will either be equal to or be less than the responsive force from the hard ground and thus the tip 206 will be caused to be in its retracted position. When the ground is sufficiently soft, the force (e.g., such as the one applied by the wearer's foot) applied to the plunger 204 will be greater than the responsive force from the soft ground and thus the tip 206 will be caused to be in its extended position. This additional length of the tip 206 extending from the stud base will dig a deeper into the softer ground and provide additional traction.

The self-adjusting stud also optionally includes an annular stud base 242, as shown in FIG. 2. This example annular stud base 242 has a center portion with a hole 243 defined therethrough. The impact-attenuating assembly 202, the plunger 204, and the tip 206 engage with one another through the hole 243 in the annular stud base 242. In this example construction, the annular stud base 242 is attached to the sole structure of the article of footwear to secure the self-adjusting stud to the sole structure. The annular stud base 242 may have a first portion 244 and a second portion 246. The first portion 244 of the annular stud base 242 is attached to the sole structure in any suitable manner, such as adhesive, molding, cementing, bonding, gluing, mechanical connectors, etc. The first portion 244 of the annular stud base 242 has a radius that is greater than the radius of the second portion 246 of the annular stud base 242. The first portion 244 of the annular stud base 242 also defines an interior space 248 with a shoulder 250. The interior space 248 is sized so that the first portion 222 of the impact-attenuating member rests on the shoulder 250. The leaf spring 233 of the impact-attenuating element 214 fits within the first portion 222 of the impact attenuating member 202 and is positioned proximate to (or in this example rests physically upon) the shoulder 250 of the first portion 244 of the annular stud base 242. The second portion 246 of the annular stud base 242 functions as a conventional static cleat in this example structure.

This example embodiment of the self-adjusting stud is described and illustrated with elements that have a smooth, curved shape. Alternative embodiments may include elements that have one or more flat sides or any other configuration of contours and shapes.

D. Self-Adjusting Studs in Articles of Footwear

Articles of footwear incorporating the self-adjusting studs may be athletic footwear known as "cleats" or "spikes." Such cleats having self-adjusting studs may be useful in a variety of sports such as soccer, baseball, golf, football, hiking, mountain climbing, lacrosse, field hockey, and the like.

Articles of footwear may include a sole structure and an upper attached to the sole structure that together define a void for receiving a foot of a wearer. The sole structure may include a sole base member and at least one of the self-adjusting studs described above. The self-adjusting studs are attached to or integrally formed with the sole base member. The sole structure may include two or more of the self-adjusting studs. In the examples in which the sole structure includes two or more self-adjusting studs, the self-adjusting studs may be all of the same construction or they may be different constructions. For example, a sole structure may include two self-adjusting studs in which one is of the construction described in the first embodiment described above and the second is of the construction described in the second embodiment described above.

The self-adjusting stud(s) may be positioned on the sole base member in any region of the sole structure. For example, one or more self-adjusting studs may be positioned in the forefoot region and/or heel region of the sole structure. More specifically, one or more self-adjusting studs may be positioned along either or both of the medial edge and the lateral edge of the forefoot and/or heel region of the sole structure.

D. Conclusion

While the invention has been described with respect to specific examples including presently implemented modes of carrying out the invention, numerous variations and permutations of the above described systems and methods may also be implemented. Thus, the spirit and scope of the invention should be construed broadly as set forth in the appended claims.

The invention claimed is:

1. An article of footwear comprising:

a sole structure; and a self-adjusting stud, the self-adjusting stud including a static cleat and an extendable element, and wherein the static cleat extends downward from a bottom surface of the sole structure, the static cleat has a hole defined therein, the hole having an opening on a bottom of the static cleat, the extendable element includes a shaft and a leaf spring, the shaft extends through the static cleat hole, a lower end of the shaft protruding through the opening, the extendable element is movable between an extended position in which the static cleat and the extendable element have a first combined length and a retracted position in which the static cleat and the extendable element have a second combined length less than the first combined length, and the leaf spring radiates outward from an upper end of the extendable element and biases the shaft to the retracted position.

2. The article of footwear of claim 1, wherein the leaf spring rests on a shoulder, the shoulder includes a plurality of tabs formed thereon, and each of the tabs rests within a corresponding slit in the leaf spring.

3. The article of footwear of claim 1, further comprising a housing, and wherein the housing includes a first portion that rests within the static cleat hole and a second portion that is wider than the static cleat hole, a hole is defined in the housing, and the shaft is located within the housing hole.

4. The article of footwear of claim 3, wherein the leaf spring rests on a shoulder defined on the housing second portion, the housing hole has an opening on a bottom of the housing, and the shaft protrudes through the housing opening.

5. The article of footwear of claim 4, wherein the leaf spring is rotationally constrained, relative to the housing, about an axis passing through the housing hole and the static cleat hole.

6. The article of footwear of claim 4, wherein the shoulder includes a plurality of tabs formed thereon, and each of the tabs rests within a corresponding slit in the leaf spring.

7. The article of footwear of claim 3, wherein an end of the housing first portion protrudes through the opening of the static cleat hole.

8. The article of footwear of claim 1, further comprising a plunger having a flat top positioned above the leaf spring and an elongated portion extending through a hole defined in the extendable element.

9. The article of footwear of claim 1, further comprising a second self-adjusting stud, the second self-adjusting stud further comprising a second static cleat and a second extendable element, and wherein the second static cleat extends downward from the bottom surface of the sole structure, the second static cleat has a hole defined therein, the second static cleat hole having an opening on a bottom of the second static cleat, the second extendable element protrudes through the second static cleat opening, and the second extendable element is movable between an extended position in which the second static cleat and the second extendable element have a third combined length and a retracted position in which the second static cleat and the second extendable element have a fourth combined length less than the third combined length.

10. An article of footwear comprising:

a sole structure; and a self-adjusting stud, the self-adjusting stud including a static cleat, a housing and an extendable element, and wherein the static cleat extends downward from a bottom surface of the sole structure, the static cleat has a hole defined therein, the static cleat hole having an opening on a bottom of the static cleat, the housing includes a first portion that rests within the static cleat hole, a second portion that is wider than the static cleat hole, and a hole extending through the first and second portions, the housing hole having an opening on a bottom of the housing, an end of the housing first portion protrudes through the static cleat opening, the extendable element includes a shaft extending through the housing hole, a lower end of the shaft protruding through the housing opening, the extendable element is movable between an extended position in which the static cleat and the extendable element have a first combined length and a retracted position in which the static cleat and the extendable element have a second combined length less than the first combined length, and the shaft is biased to the retracted position.

11. The article of footwear of claim 10, wherein the shaft is rotationally constrained, relative to the housing, about an axis passing through the housing hole and the static cleat hole.

12. The article of footwear of claim 10, further comprising a plunger having a flat top positioned above the extendable element and an elongated portion extending through a hole defined in the extendable element.

13. The article of footwear of claim 10, wherein the shaft is biased to the retracted position by compressible foam.

14. The article of footwear of claim 10, wherein the shaft is biased to the retracted position by a spring.

15. The article of footwear of claim 10, further comprising a second self-adjusting stud, the second self-adjusting stud further comprising a second static cleat and a second extendable element, and wherein the second static cleat extends downward from the bottom surface of the sole structure, the second static cleat has a hole defined therein, the second static cleat hole having an opening on a bottom of the second static cleat, the second extendable element protrudes through the second static cleat opening, and the second extendable element is movable between an extended position in which the second static cleat and the second extendable element have a third combined length and a retracted position in which the second static cleat and the second extendable element have a fourth combined length less than the third combined length.

* * * * *